US009457587B2

(12) United States Patent
Howarth et al.

(10) Patent No.: US 9,457,587 B2
(45) Date of Patent: Oct. 4, 2016

(54) AUTOMATIC THERMAL PRINT ON DEMAND PRODUCE LABELER

(71) Applicants: M. Scott Howarth, Clovis, CA (US); Wilson B. Murray, Fresno, CA (US); Justin L. Graham, Clovis, CA (US); Russell Mitchell, San Diego, CA (US); Ethan Davis, San Diego, CA (US); Ilyn Gavilyuk, San Diego, CA (US); Andrew Nichols, San Diego, CA (US)

(72) Inventors: M. Scott Howarth, Clovis, CA (US); Wilson B. Murray, Fresno, CA (US); Justin L. Graham, Clovis, CA (US); Russell Mitchell, San Diego, CA (US); Ethan Davis, San Diego, CA (US); Ilyn Gavilyuk, San Diego, CA (US); Andrew Nichols, San Diego, CA (US)

(73) Assignee: Sinclair Systems International, LLC, Fresno, CA (US)

( * ) Notice: Subject to any disclaimer, the term of this patent is extended or adjusted under 35 U.S.C. 154(b) by 0 days.

(21) Appl. No.: 14/756,713

(22) Filed: Oct. 2, 2015

(65) Prior Publication Data

US 2016/0136964 A1 May 19, 2016

Related U.S. Application Data

(63) Continuation-in-part of application No. 14/756,175, filed on Aug. 12, 2015.

(60) Provisional application No. 62/060,267, filed on Oct. 6, 2014.

(51) Int. Cl.
*B41J 25/304* (2006.01)
*B41J 2/335* (2006.01)
*B41J 3/407* (2006.01)

(52) U.S. Cl.
CPC ..... *B41J 2/335* (2013.01); *B41J 3/4075* (2013.01)

(58) Field of Classification Search
CPC ..... B41J 2/335; B41J 3/4075; B41J 25/304; B41J 25/308; B41J 25/3082; B41J 25/3084; B41J 25/3086
See application file for complete search history.

(56) References Cited

U.S. PATENT DOCUMENTS 4,879,566 A * 11/1989 Hanabusa ..... B41J 25/312 347/198
5,206,662 A * 4/1993 Fox ..... B41J 25/312 347/198
2011/0193925 A1* 8/2011 Matsushima ..... B41J 15/042 347/197

* cited by examiner

*Primary Examiner* — Kristal Feggins
(74) *Attorney, Agent, or Firm* — Bruce H Johnsonbaugh

(57) ABSTRACT

An automatic, thermal print on demand labeler is provided. The thermal print head is placed above the axis of rotation of the rotary head, with a cylindrical platen mounted horizontally opposite the print head. A stripper pin is mounted below the platen; the pin is positioned very close to the print region of the print head. This positioning of components results in a label being printed and dispensed onto a bellow in one index of the multi-bellow rotary head. Independent direct gear drive trains are provided for the rotary head and label tape drive.

15 Claims, 10 Drawing Sheets

AUTOMATIC THERMAL PRINT ON DEMAND PRODUCE LABELER

CROSS REFERENCE TO RELATED APPLICATION

This application claims the benefit of and priority from U.S. provisional application Ser. No. 62/060,267 filed Oct. 6, 2014.

This application is a continuation-in-part of U.S. application Ser. No. 14/756,175 filed Aug. 12, 2015.

BACKGROUND

The demand for automatic, high speed produce labelers continues to rise worldwide. Similarly, the demand for relatively low cost and relatively high speed produce labelers continues to rise.

The present invention satisfies both of the above demands.

SUMMARY OF INVENTION

The present invention provides an automatic direct thermal image printing system capable of printing on demand labels at a reasonable cost and at reasonably high speeds expected to be approximately 240 to 840 labels per minute per lane. The phrase "print on demand" means that the labeler senses a characteristic, such as size, of each individual produce item as the item approaches the printer, and the labeler prints and applies a specific variable label for each item. The concept of automatic, variable "print and apply" produce labeling is taught in U.S. Pat. Nos. 7,168,472 and 8,570,356, both of which are incorporated herein by reference as though set forth in full. The teachings of those two patents are not repeated here for the sake of brevity.

The new system disclosed below provides a print-head location relative to the label stripping location whereby a label is printed and dispensed onto a bellow in one index of the rotary head. This placement minimizes and optimizes the distance between the print-head and label stripping point.

The new system also provides improved and independent drive mechanisms for the rotary head and the label carrier tape (or strip). The rotary head is driven by an improved and simplified direct gear drive system using a dedicated stepper motor and three directly driven gears. This drive system eliminates more than half the moving parts of typical prior art rotary head drives. The present system also provides an independent drive system for the label carrier tape. This separate tape drive system is "decoupled" from the rotary head drive.

Other improved features shown and described below include:

1) A label detection sensor.
2) Improved tape centering.
3) Extended bellow life.

DETAILED DESCRIPTION OF DRAWINGS

Figure 1:
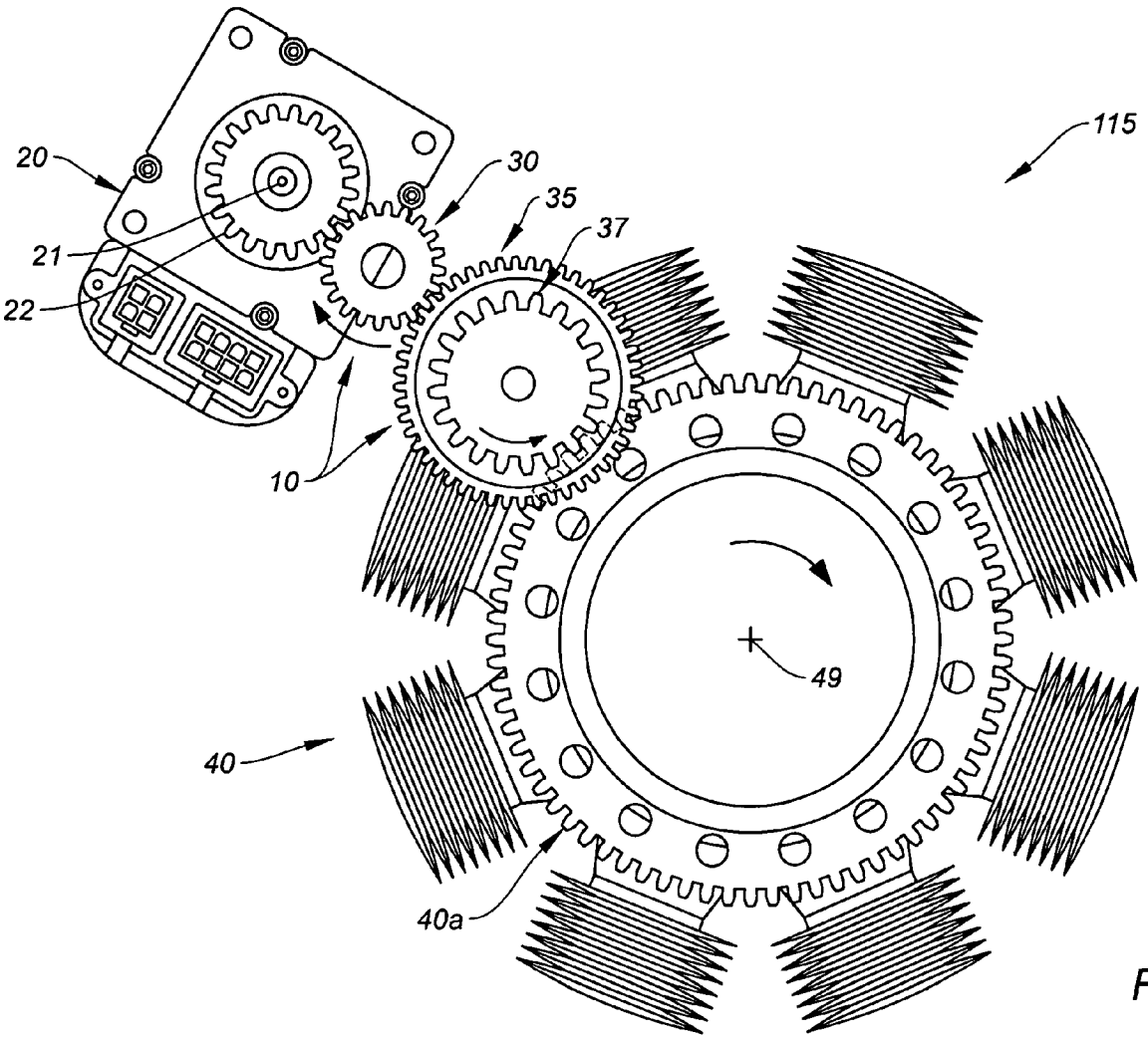
FIG. 1 is a schematic illustration of the label applicator 115 with its direct gear drive train 10 for the rotary head 40.
Figure 2A:
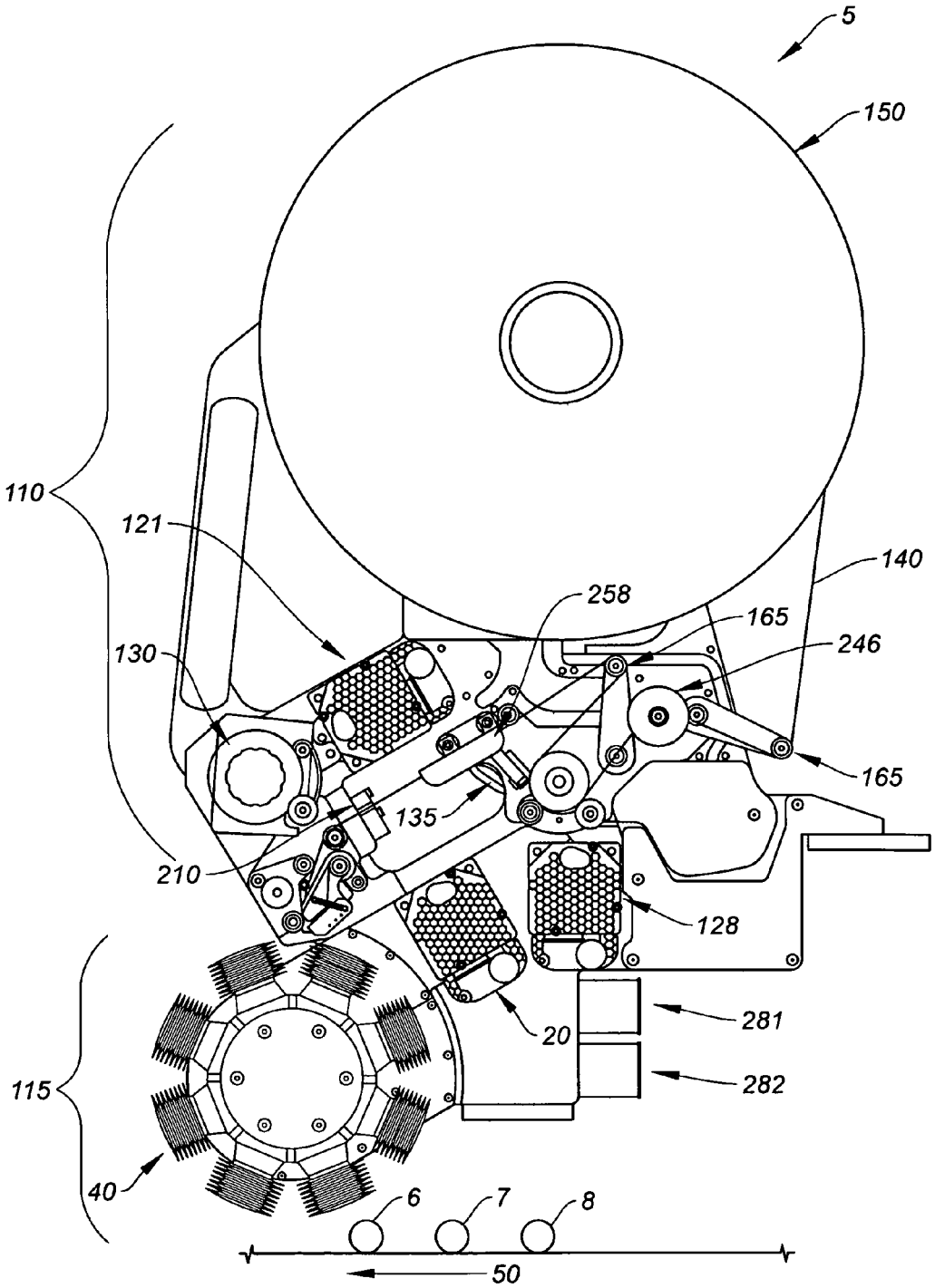
FIG. 2A is a schematic showing the rotary head in position below the label cassette reel and drive.
Figures 2B, 2C, 2D:
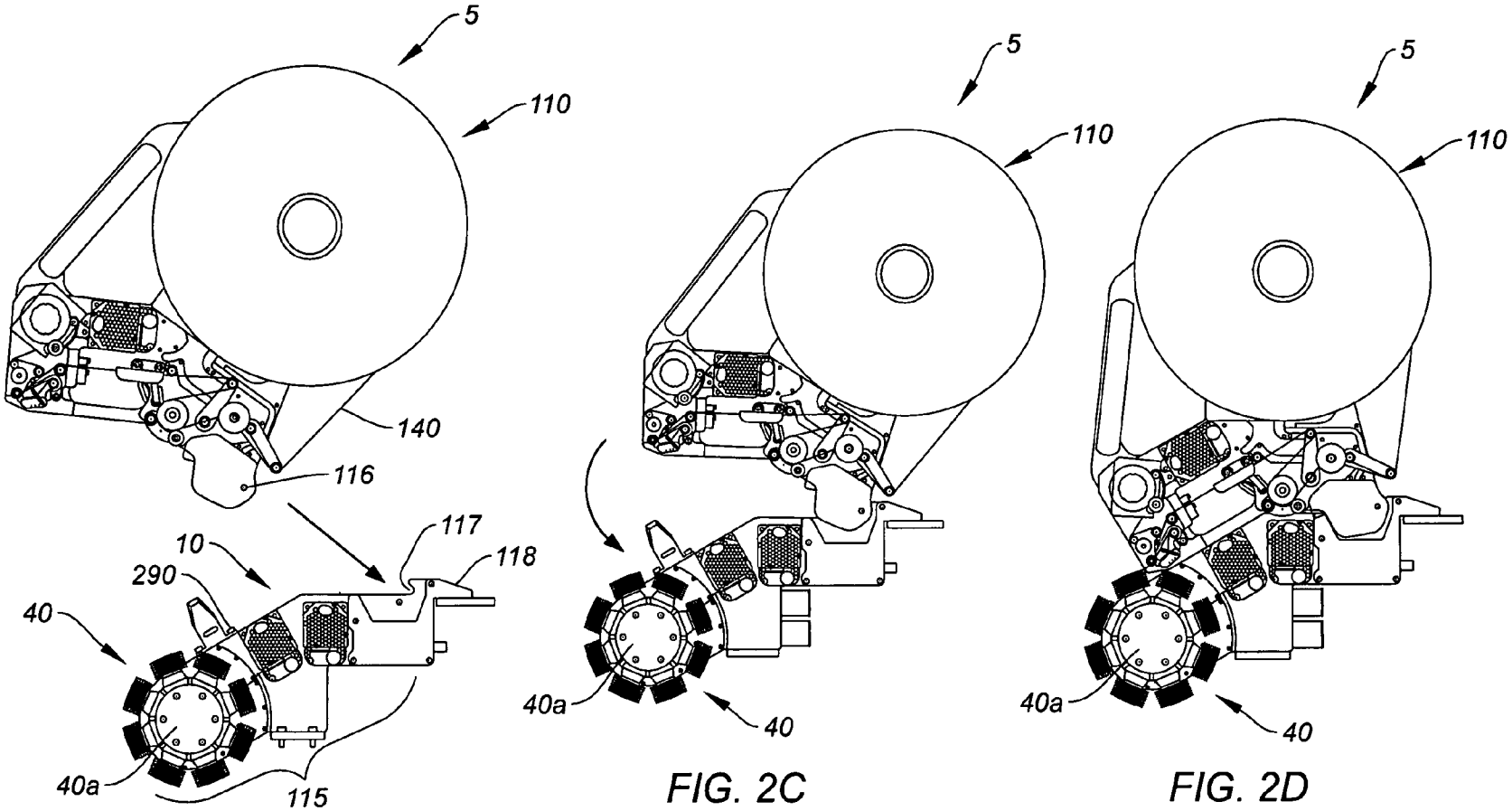
FIGS. 2B, 2C and 2D illustrate how the detachable label cassette is hingedly attached to label applicator 115.

FIGS. 1, 2A-2D illustrate the general layout of the automatic labeling machine, shown generally as 5 in FIGS. 2A-2D. The two major components are the label applicator 115 (FIGS. 1 and 2B) and a detachable label cassette 110 (FIG. 2B). Detachable label cassette 110 as shown in FIGS. 2B-2D is hingedly connected to label applicator 115 by pin 116 at the base of label cassette 110 engaging recess 117 formed at the top of label applicator 115 in knuckle 118. FIGS. 2C and 2D show how label cassette 110 is hingedly and detachably mounted to label applicator 115. Pin 116 is first slipped into recess 117 as shown in FIG. 2C, and then label cassette 110 is rotated downwardly into engagement with label applicator 115 as shown in FIG. 2D. The rotary head 40 together with its drive motor 20 and gear train 10 are referred to herein as the label applicator 115. The label applicator has a plurality of preferably 8 bellows carried on an indexable rotary head 40*a*. As shown in FIG. 1, rotary head 40 has 8 index positions, spaced equally every 45 degrees around the horizontal axis of rotation 49 of rotary head 40. As is known generally in the art, individual labels from label carrier strip 140 (FIG. 2A) are transferred onto the tip of a single bellow, and thereafter onto individual items of produce 6-8 as shown in FIG. 2A moving in the direction of arrow 50.

FIG. 1 is a schematic illustrating the rotary head direct gear drive train shown generally as 10. A stepper motor 20 has an output shaft 21 which carries a preferably plastic gear 22, rotating in a counter-clockwise direction as viewed in FIG. 1. Gear 22 preferably has 30 teeth. Idler gear 30 has 25 teeth preferably and is driven directly by motor output gear 22. Idler gear 30 is preferably plastic and rotates in a clockwise direction as viewed in FIG. 1. Idler gear 30, in turn, drives gear 35, wherein gear 35 has 50 teeth. Gear 37 rotates with gear 35; gear 37 has 24 teeth. Both gears 35 and 37 rotate counter clockwise in FIG. 1.

An eight bellow rotary head 40 is driven by gear 37. The overall or final gear ratio of the drive 10 is 5 to 1, with 5 rotations of gear 22 causing one full rotation of rotary head 40.

Produce items 6-8 (FIG. 2A) are singulated and conveyed below turret 40 in the direction of arrow 50. It is significant to note that rotary head 40 may carry either eight bellows as shown in FIG. 1 or six bellows (not shown). An eight bellow rotary head operates at a 33% higher labeling speed than a six bellow turret.

FIG. 2A illustrates the rotary head 40 of FIG. 1 in position below detachable label cassette 110 which includes the label carrier strip (or label tape) reel 150 and tape drive mechanism, described further below.

FIG. 2A shows a label tape drive stepper motor 121 that drives a label tape drive hub or wheel 130 through a drive train not visible in FIG. 2A. As drive hub 130 rotates counter-clockwise, it pulls label tape (or label carrier strip) 140 off of label reel 150 and through the tensioning and printing mechanisms of FIG. 2A as described below in further detail.

Figure 3:
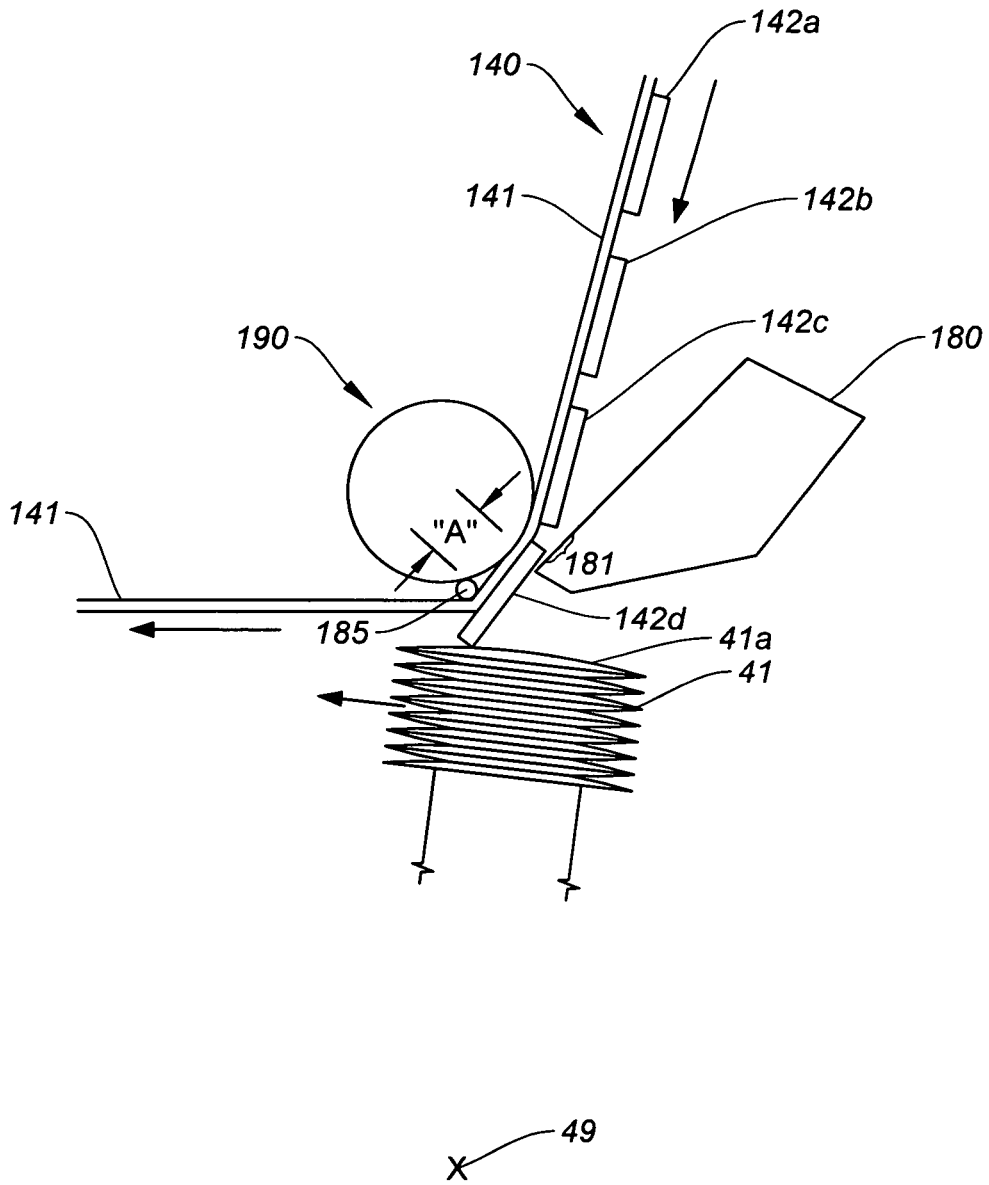
FIG. 3 is a concept sketch, not to scale, illustrating the novel placement of critical components of the system.

FIG. 3 is a "concept" sketch, not to scale, illustrating the novel and significant placement of thermal print head 180 and label stripper pin 185. Print head 180 is positioned so that its thermal printing region or area 181 is within twenty degrees, plus or minus, from being vertically aligned with the horizontal axis of rotation 49 of rotary head 40, of which only a single bellow 41 is shown in FIG. 3 for clarity. A rotatable platen 190 is positioned horizontally opposite from print head 180.

Thermal print region 181 is positioned between thermal print head 180 and cylindrical, rotating platen 190. The label carrier strip (or label tape) 140 is pulled from the label (or tape) reel 150 (FIG. 2) and is caused to move downwardly at an angle of less than 20 degrees from the vertical, between print head 180 and platen 190. Label carrier strip 140 includes a liner 141 and a plurality of thermographic labels 142; only 4 labels 142*a*-142*d* are shown in FIG. 3 for clarity. As the label strip 140 is pulled from tape reel 150 (FIG. 2A), thermographic label 142*d* is separated from liner 141 by stripper pin 185 and moves downwardly into contact with the top surface 41*a* of bellow 41 (FIG. 3). The top 41*a* of bellow 41 moves counter-clockwise in FIG. 3 at the same speed as label carrier strip 140. Stripper pin 185 is located below platen 190 and as close as possible to print region 181 print head 180.

Thermal print head 180 has a thermal print region 181 which transfers heat, for example from a laser diode array onto each of thermographic labels 142*a*-142*d* as the labels move past region 181. As shown in FIG. 3, label 142*d* has been nearly completely printed, is partially stripped from liner 141 by stripper pin 185 and has made contact with the top 41*a* of bellow 41. As bellow 41 moves counterclockwise from the position shown in FIG. 3, label 142*d* is drawn down fully onto the top surface 41*a* of bellow 41 by a vacuum system known in the art created inside bellow 41. The novelty of the design is that a label such as 142*d* is printed (as it passes through print region 181) and dispensed (as it is stripped from liner 141 by stripper pin 185) onto a bellow (41) in one index of the rotary head (as bellow 41 is indexed through a single index of a 45 degree angle for an 8 bellow rotary head). This novel result is created by the short and sufficiently small or short distance "A" between the leading (or lower) edge 181*a* (FIG. 4) of print region 181 and stripper pin 185, and by the small or short distance (less than 10 mm) between the top 41*a* of bellow 41 and stripper pin 185. Distance "A" is preferably less than 10 mm, and most preferably 6 mm or less.

A significant advantage of the configuration shown in FIG. 3 is that each label is printed before it is stripped from liner 141, before it is applied to a bellow, and as it is held against a platen, resulting in a high clarity image. A further advantage is that the configuration lends itself to increased serviceability of the print head.

As shown in FIG. 3, the top 41*a* of bellow 41 (and all bellows) is positioned as close as possible to stripping pin 185 to allow each label to contact the bellow before the label is fully stripped from liner 141. Each label is printed, at least partially, before it begins to be stripped by stripper pin 185. Bellow life is extended because each bellow does not run against a stripper pin or stripper plate; bellows in the present system do not contact the label stripper.

A constant stream of air is blown horizontally against label 42*d* (and all labels) from left to right in FIG. 3 (not shown for clarity) as it is stripped from the label liner 141. This air assists helps to prevent the label from wrapping around the stripping pin 185 and following the liner 141.

Figure 4:
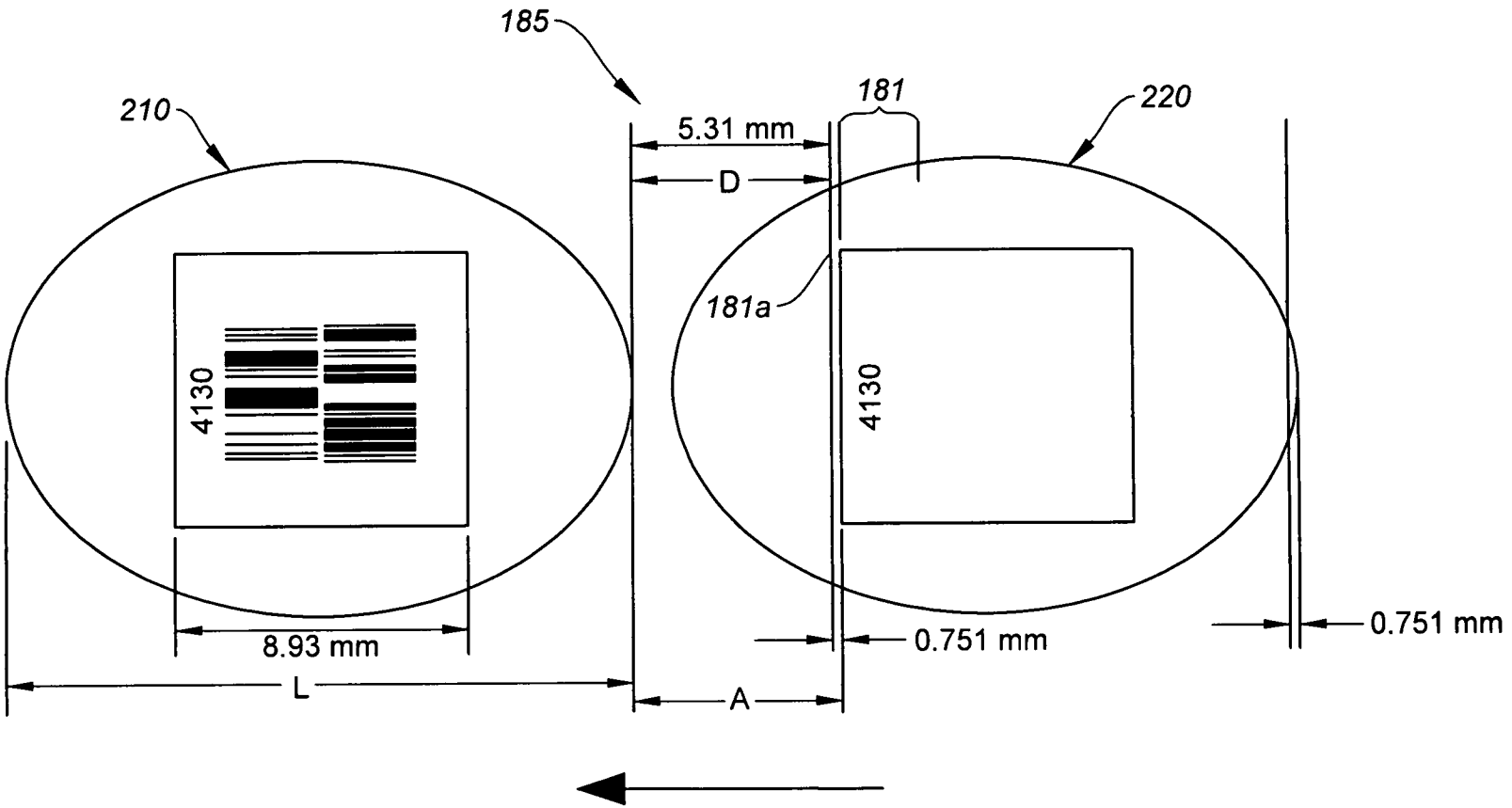
FIG. 4 is a schematic showing the relative sizes and placement of labels, print head and stripper pin.

FIG. 4 illustrates an illustration of two labels 210 and 220 shown in positions relative to the location of stripper pin 185 and print region 181 of print head 180. Labels 210 and 220 are moving to the left in FIG. 4; label 210 has been printed (by print head 180 transferring heat by a laser diode array, for example, to each thermographic label to apply a code, such as a bar code, to each label) and stripped from liner 141; label 220 is entering print region 181 and has only a portion of the bar code printed on it. Each label is printed as it is urged against platen 190 and before it is transferred to a bellow. It is significant to note that each of labels 210 and 220 has a length L of approximately 20 mm and that the distance between the leading edge 181*a* (FIG. 4) of print region 181 and stripper pin 185 is only about 6 mm. In the preferred embodiment shown in FIG. 4, each label has a length L which is greater than the distance D between the leading edge 181*a* of print region 181 and stripper pin 185. In the most preferred embodiment, the distance L is more than three times greater than the distance D. Each label preferably has a length L greater than the distance between the leading edge 181*a* of thermal print region 181 and the top of a bellow when said bellow is at its closest point to stripping pin 185.

Figure 5:
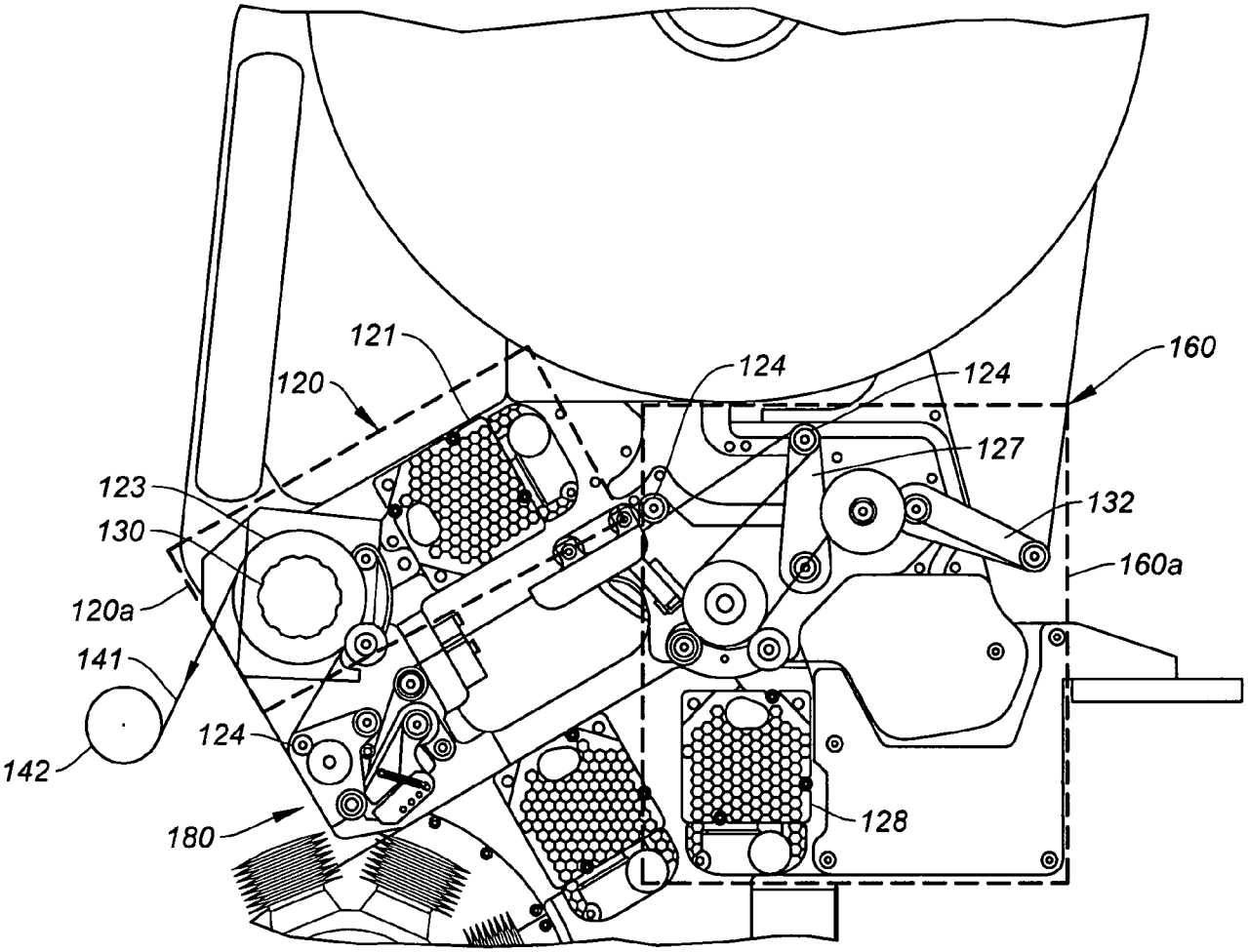
FIG. 5 is an overview schematic of the label carrier strip (or label tape drive) and tensioning system.
Figure 6:
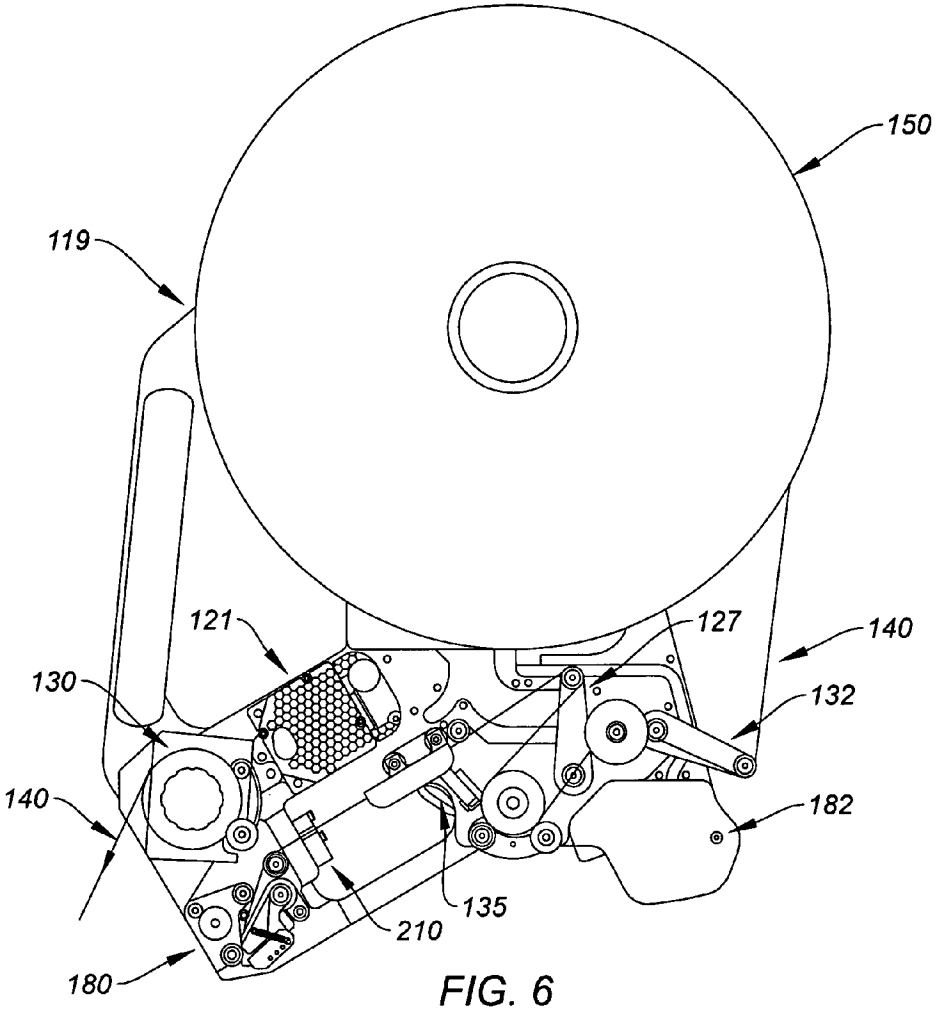
FIG. 6 is a schematic of the removable label cassette, separated from the label applicator.

FIGS. 5 and 6 illustrate the label carrier strip (or label tape) drive system shown generally as 120 and positioned inside dashed line 120*a* in FIG. 5. FIG. 5 also shows the tape tensioning system shown generally as 160 and positioned within dashed line 160*a*.

The drive motor for the label carrier strip 140 in FIG. 5 is a stepper motor 121. Motor 121 causes drive wheel 122 and drive roller 123 to rotate, creating tension in label carrier strip 140. Rollers 124 together with tension arm 127 keep the label carrier strip 140 in tension and help to pull the label carrier strip 140 without over-pulling, which results in the label carrier strip 140 unwinding too far. An optical tension sensor 135 (FIG. 6) measures the preload on tension arm 127 (FIG. 5) and commands the tension motor 128 to release label carrier strip 140 as necessary to keep the label carrier strip 140 tension at a software controlled level. The label carrier strip 140 is also tensioned dynamically by varying the acceleration profiles of the drive stepper motor 121 and tension motor 128, causing the inertia of tension arm 127 to add tension to strip 140. The tension motor 128 primes the tape 140 for the drive (or index) motor 121 by buffering the motor 121 from any tape reel dependent effects, causing the loading on the motor 121 to be similar from label to label. It is also important to maintain tension in strip 140 from the print head 180 to the drive hub 130; this helps provide good print quality and prevents breaking or tearing of strip 140. Tension motor 128 drives in parallel with drive motor 121. Tension motor 128 provides the proper tension to the label carrier strip 140 for the strip or tape 140 to drive through while providing the proper tension to strip labels from the carrier strip.

Tensioner arm 127 maintains a constant tension in label tape 140. Locating the label tape drive hub 130 downstream of the tensioning and printing mechanisms provides a relatively constant tension on label tape 140, reducing tearing of the tape and resulting labeling down time.

An optional feature is a backup roll 142 (FIG. 5) onto which the liner 141 is wound.

Figure 7:
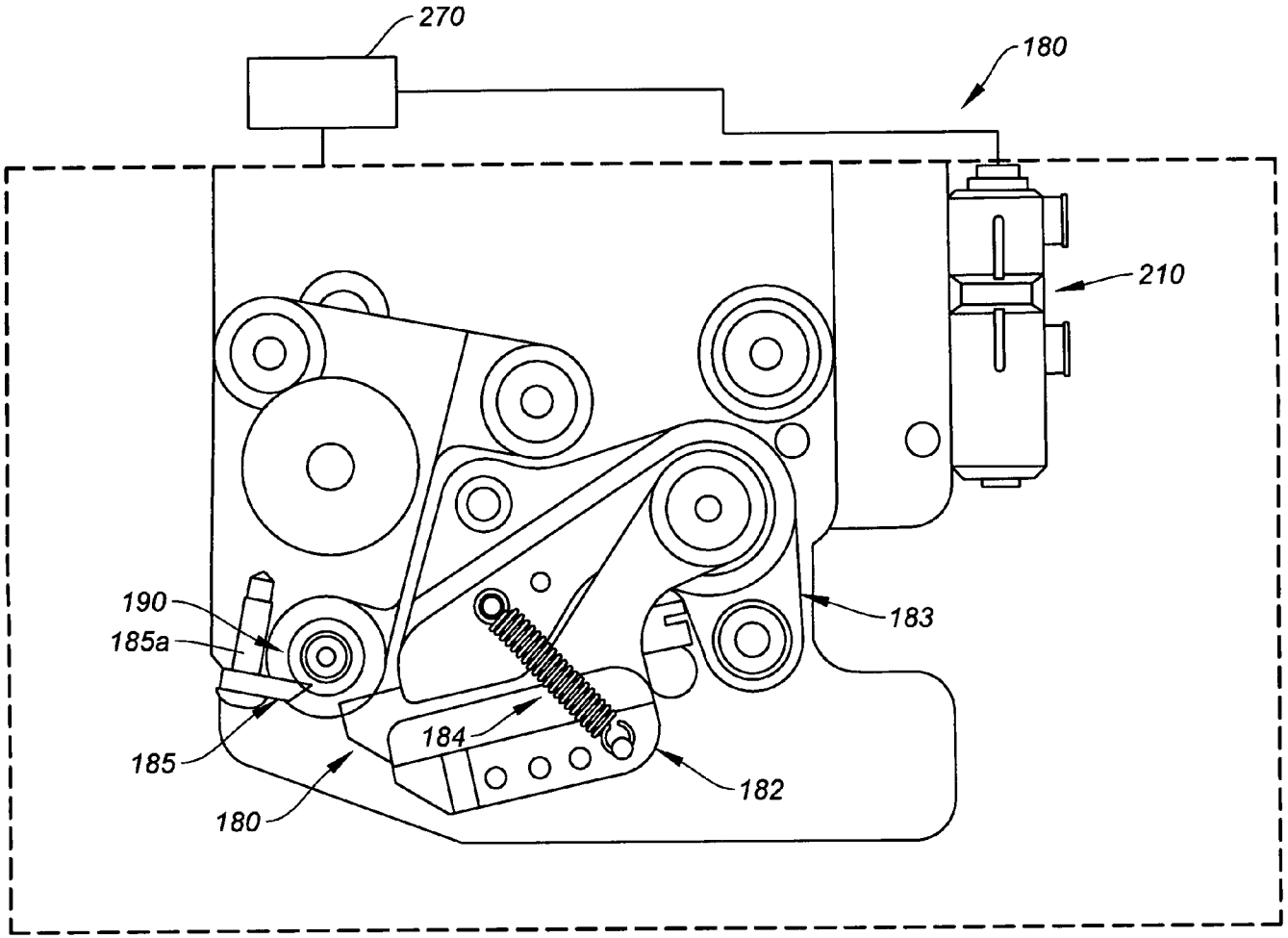
FIG. 7 illustrates the thermal printer components.

As shown best in FIG. 7, stripper pin 185 is rotatably carried by a cylindrical mounting pin 185*a*. Stripper pin 185 is readily rotated away from platen 190 to ease the lacing of label carrier strip 140, and to facilitate cleaning and servicing print head 180.

FIG. 7 illustrates the components of the printer assembly 180. In use, the assembly 180 shown in FIG. 7 is rotated to the position shown in FIGS. 2, 3 and 5. Print head 180 may be a known direct thermal print-head scan available from Gulton (www.gulton.com) or Kyocera (http://global.kyocera.com). Print head 180 is mounted inside a print head hinge 182. The print head hinge 182 floats in an elongated hole in print head frame 183, allowing print head 180 to rotate to the angle of the surface of platen 190 to ensure good contact. Two extension springs 184 (only one of which is visible in FIG. 7) apply proper and even print head pressure on platen 190 (FIG. 3). The platen is captured in a platen rotator which can swivel away from the print head 180 for ease of lacing while reducing the chance of print head damage.

A significant aspect of the improved label dispensing technique is that a label release (or stripping) pin 185 is used, as opposed to a typical stripper plate, to separate each label from the carrier strip. This improved design extends the life of the bellows, since the bellows do not frictionally run against the bottom of a typical stripper plate.

A label detection sensor 210 (FIGS. 6 and 7) is positioned adjacent to and upstream from print head 180. Sensor 210 signals the print head controller 270 to accelerate, fire and then decelerate.

Figure 8B:
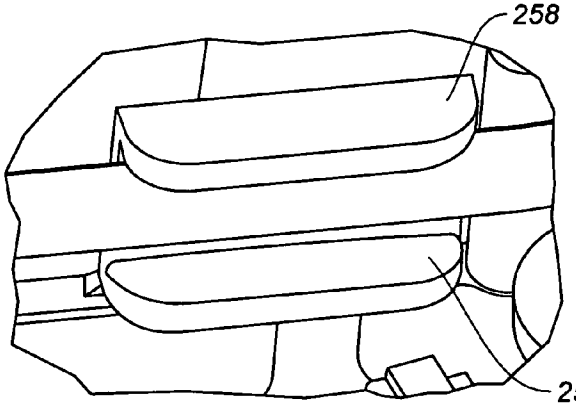
FIGS. 8A-8C illustrate the label tape centering components.
Figure 8C:
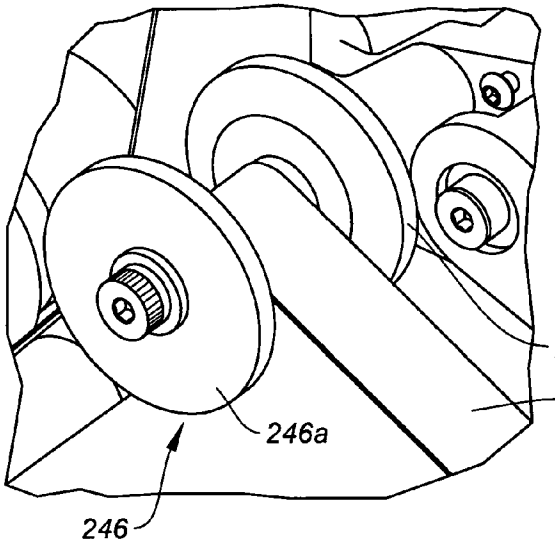
Figure 8A:
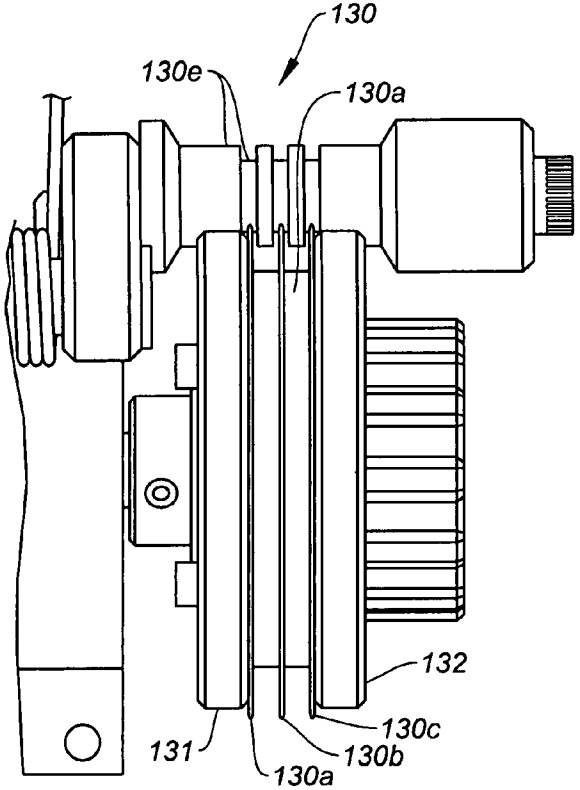

FIG. 8A-8C illustrates how the improved centering system acts on the label carrier tape 140 to center the tape as it moves through the label cassette 110 to drive hub 130 (FIG. 2A). Drive hub 130 (FIGS. 2A and 8A) includes a spiked center wheel 130*a* having three rows of radially extending spikes 130*b*, 30*c* and 130*d*. Spikes 130*a*-130*c* pierce the liner 141 (not shown). A grooved shaft 130*e* above wheel 130*a* prevents liner 141 from coming off wheel 130*a*. Wheel 130*a* and spikes 130*a*-130*c* are held together by discs 131, 132.

As the label carrier strip 140 is pulled off reel 150 by drive hub 130, it is centered by guide roller 246 (FIG. 2A). Guide roller 246 has centering hubs 246*a*, 246*b* which keep label carrier strip 140 centered. The tape 140 is also centered by guide channel 258, 259 (FIGS. 2A, 8B). This centering device allows for scallop tape label strips, straight edge label strips, etc., which is important in the manufacturing of labels by allowing labels to be nested and therefore maximizing laminate utilization (a significant decrease in laminate waste). The centering device is an improvement over the current design which uses a scalloped wheel, which must match the specific scallop design.

Figure 9A:
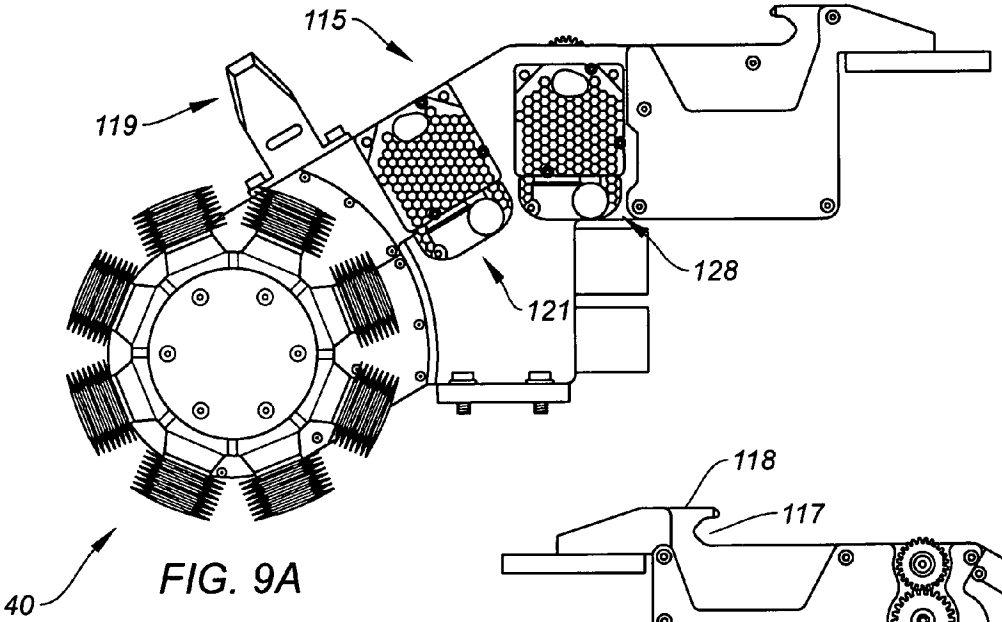
FIGS. 9A-9B illustrate the overall layout of the label applicator 115, which includes rotary head 40 and its direct gear drive and drive motor.
Figure 9B:
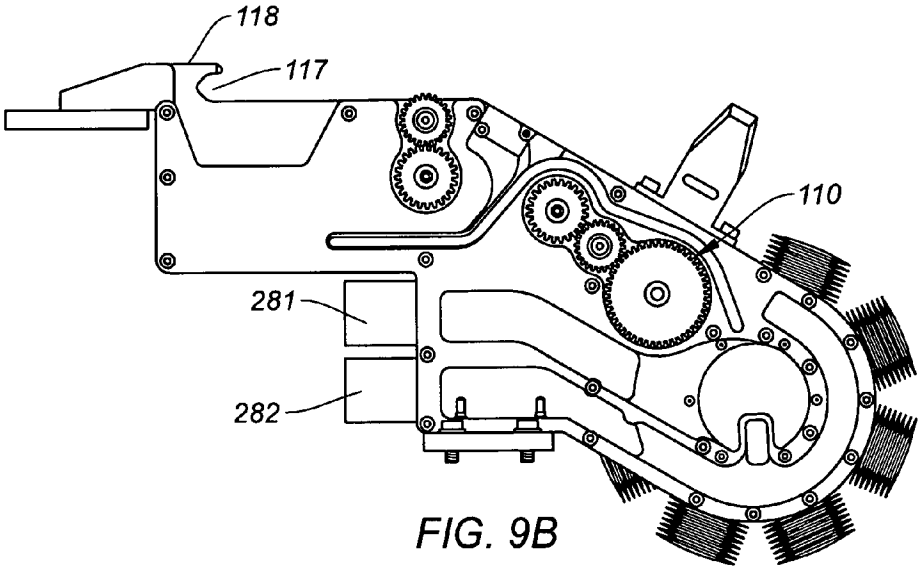

FIGS. 9A-9B illustrate the overall layout of label applicator 115. FIG. 9B shows the reverse side of applicator 115 shown in FIG. 9A.

A user interface 119 is included with buttons to advance rotary head position relative to label dispensing location. This allows for label dispensing to be easily adjusted for best performance.

Pneumatic inlets 281 and 281 provide vacuum and air pressure as needed to actuate the bellows.

Power for the stepping motors 20, 121 and 128 (48 VDC) flows into the printed circuit board of applicator 115 and into a blind mating interconnection by a microlimit switch 290 (FIG. 2B) which detects the presence of a properly positioned cassette. This is a safety means that protects both operators and equipment.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated.

We claim:

1. An automatic, thermal print on demand, labeling machine used to apply thermographic labels to produce, wherein a label applicator having a plurality of bellows carried on an indexable rotary head is utilized to transfer individual thermographic labels from a label carrier strip, onto the tip of a single bellow, and thereafter onto individual items of produce wherein said rotary head has a horizontal axis of rotation, comprising:

a thermal print head positioned above said axis of rotation of said rotary head, a rotatable, cylindrical platen positioned above said axis of rotation of said rotary head and opposite said thermal print head means for moving said label carrier strip downwardly between said platen and said thermal print head a thermal print region between said thermal print head and said platen, at which region said thermal print head transfers heat to each of said thermographic labels to apply a code to said labels a label stripper pin positioned below said rotating platen, said label stripper pin being positioned a distance from said thermal print region wherein said distance is sufficiently small that a label is printed and dispensed onto a bellow in one index of said rotary head.

2. The apparatus of claim 1 wherein each of said labels is printed before it is transferred to one of said bellows.

3. The apparatus of claim 1 wherein the printing of each of said labels is begun before said label is stripped from said label carrier strip.

4. The apparatus of claim 1 wherein each of said labels has a length greater than said distance between said label stripper pin and said thermal print region.

5. The apparatus of claim 4 wherein each of said labels has a length greater than the distance between said thermal print region and the top of a bellow when said bellow is at its closest point to said stripping pin.

6. The apparatus of claim 1 wherein said thermal printer is positioned so that said thermal print region is located within plus or minus 20 degrees of being vertically aligned with said axis of rotation of said rotary head.

7. The apparatus of claim 1 wherein said indexable rotary head is driven by a first, dedicated stepper motor through a direct, clutchless gear drive.

8. The apparatus of claim 7 wherein said means for moving said label carrier strip comprises a label cassette detachable from said label applicator, and a second, dedicated stepper motor which operates independently of said first stepper motor.

9. The apparatus of claim 8 further comprising a plurality of rollers wherein said label carrier strip passes over said plurality of rollers, further comprising centering means for centering said label carrier strip on said rollers.

10. The apparatus of claim 8 further comprising tensioning means for said label carrier strip.

11. The apparatus of claim 9 wherein said tensioning means comprises a tensioning motor which drives in parallel with said means for moving said label carrier strip, wherein said tensioning motor provides proper tension to said label carrier strip for said label carrier strip to drive through while providing proper tension to label carrier strip to strip labels from said label carrier strip.

12. The apparatus of claim 8 further comprising safety means, wherein said safety means includes a microlimit switch that restricts power in the absence of a properly positioned label cassette.

13. The apparatus of claim 1 further comprising a print head controller and label detection means to detect the presence of a label approaching said print head and to signal said print head controller to actuate said print head, wherein said label detection means is mounted adjacent to and upstream of said print head.

14. The apparatus of claim 1 further comprising a cylindrical mounting pin which carries said label stripper pin.

15. The apparatus of claim 14 wherein said label stripper pin is rotatable on said cylindrical mounting pin to facilitate servicing of said print head and lacing of said label carrier strip.

* * * * *